United States Patent [19]

Hofmann

[11] 3,946,627

[45] Mar. 30, 1976

[54] ROTARY APPARATUS FOR PUNCHING APERTURES INTO CORRUGATED BOARD MATERIAL

[76] Inventor: Alfred Hofmann, Nordstrasse 11, 4135 Kapellen Krs. Moers, Germany

[22] Filed: Feb. 11, 1974

[21] Appl. No.: 441,725

[30] Foreign Application Priority Data

Feb. 16, 1973 Germany ..... 7305842[U]

[52] U.S. Cl. ..... 83/117; 76/107 C; 93/36 A

[51] Int. Cl.[2] ..... B26D 7/18

[58] Field of Search ..... 83/117, 103, 116, 115, 83/140; 93/36 A; 76/107 C

[56] References Cited

UNITED STATES PATENTS

| | | | |
|---|---|---|---|
| 168,011 | 9/1875 | Fry | 83/117 |
| 623,862 | 4/1899 | Armstrong | 83/117 |
| 687,905 | 12/1901 | Seymour | 83/117 |
| 2,113,843 | 4/1938 | Kavle | 83/117 |
| 2,302,855 | 11/1942 | Hallman | 83/117 |
| 2,522,154 | 9/1950 | Asmussen | 83/117 |
| 2,679,291 | 5/1954 | Collinson | 83/284 |
| 3,188,900 | 6/1965 | Mauro | 76/107 C X |
| 3,395,598 | 8/1968 | Martin | 76/107 C X |
| 3,524,364 | 8/1970 | Bishop | 83/103 |
| 3,552,244 | 1/1971 | Smith | 83/103 X |
| 3,807,262 | 4/1974 | Vits | 83/117 |

*Primary Examiner*—Frank T. Yost
*Attorney, Agent, or Firm*—Michael J. Striker

[57] ABSTRACT

A rotary cylinder is mounted opposite abutment means, and has a metal strip upstandingly mounted on the cylinder, with an exposed edge for cutting out a portion of said material. In order to automatically eject the cutout portions, at least one resilient ejector is mounted on the cylinder, within and adjacent the cutting strip. Advantageously, the ejector is provided in form of telescoping, outwardly spring-loaded shells, mounted on the cylinder to extend generally radially of the cylinder.

17 Claims, 4 Drawing Figures

ROTARY APPARATUS FOR PUNCHING APERTURES INTO CORRUGATED BOARD MATERIAL

BACKGROUND OF THE INVENTION

The invention relates to rotary punching apparatus for punching apertures into corrugated board material. Apparatus of this type comprises a rotatable cylinder with cutting means thereon, usually provided by steel strips mounted along one edge or edges on the cylinder by means of suitable mounting means while the opposite free edge or edges form cutting knife edges. The punching means is advantageously formed by a tray of suitable curvature for mounting on the cylinder and for interchangeable securement to the cylinder with the knife edge forming steel strip on the tray.

Apertures are cut into the corrugated board material by the knife edges of the cutting tool. These knife edges may either have an endless outline to cut an aperture of corresponding outline into the corrugated board mateiral, in which case it is desirable to remove the portion of the board material within the said outline, as scrap; or the knife edges may have an outline so that the cut portion of such material remains attached to the board material which is being punched; in this latter case, the punched out material remains on and continues to move with the corrugated board which has been punched. In both cases it is generally desired to form clearly defined apertures, that is in the first case to entirely remove the scrap from the board, and in the other case to properly control the position of the cut-out board portion, relative to the general board surface whereto it remains attached.

Heretofore difficulties have been encountered in the endeavor to properly form punched-out apertures in corrugated board material. Scrap portions used to adhere to the surrounding board material, even if the cutting tool had cut properly into and through this material; and similarly, the positions of the partly cut-out board portions, relative to the general plane of the board have been unpredictable. In some prior-art apparatus, particularly in so-called shallow punch presses or flat punching apparatus, rubber bodies have been provided in the vicinity of the cutting edges in order to prevent the undesired adhesion of board or scrap material, either to each other or to the cutting edges. Such arrangements are not intended for use on rotary punch apparatus and are not suitable for such use. Due to the resilience of the corrugated board material itself, cut-out portions and particularly scrap have tended to adhere to the processed board material discharged from rotary punching apparatus and it has therefore been usual to pass the processed board material which has left the punching cylinder, over vibrators for shaking off the adherent scrap or marginally cut-off portions. The vibrating apparatus is expensive, noisy, and not really effective; it has been found that scrap has been moved along with the cut corrugated board material and that it was necessary to resort to manual sorting and manual breaking out, which of course is very expensive. Briefly: the conventional rotary punches for corrugated board material required complex and expensive provisions, such as vibrators followed by manual sorting and breaking out facilities, between the rotary punching cylinder and the further apparatus where the punched boards are either bundled for shipment or placed in readiness for treatment by further tool machines.

SUMMARY OF THE INVENTION

It is an object of this invention to avoid the problems and disadvantages heretofore encountered in connection with the punching of corrugated board material. It is a further object to provide for the punching apertures in corrugated board material and reliably to eject the punched-out material portions.

A further object is to provide a rotary punch for corrugated board material with means for automatically ejecting punched-out material from the apertures punched into the material, without any need of vibrators and of manual sorting and breaking out.

The invention achieves these objects by novel apparatus for rotary punching of corrugated board material having at least one resilient ejector means which normally projects from the rotary cylinder beyond the cutting edge of the knife means on said cylinder; the so-projecting ejector means being effective to displace board material, corresponding to the punched apertures, from the remaining board material incident to further rotation of said cylinder. Advantageously the ejector means project beyond said knife edge by a distance at least slightly greater than the normal thickness of the corrugated board material. The ejector is resiliently movable incident to said cutting into a position wherein said knife edge projects beyond the ejector.

It has been found that corrugated sheet material cut in accordance with the above-described general form of the invention has tended (depending on the type and thickness of the material) upon its passage from the working gap to bend or yield downwardly and thereby practically to elude the ejector means, whereby the effect of this latter means and particularly the automatic breaking out of the scrap portion would be impaired. In such cases it is preferred to provide the apparatus with additional abutment means arranged for preventing such yielding or bending of the punched board material, in the area where the resilient ejection means resumes the normal position thereof. This latter abutment means accordingly serves to abut the portions, board material while board material poritons, such as scrap, are being removed from the general plane of such material. The additional abutment means advantageously comprises substantially rigid sheet means adjustably mounted on transverse rods or bars opposite the rotary cylinder, located closely adjacent but outside the apertures punched into the board material, these sheet means being provided in addition to abutment means for the cutting edge, and in an area of the cylinder rotation past the abutment means for the cutting means. Instead of these additional generally stationay, rigid sheet means the additional abutment means may be constructed in form of conveyor belts, which may also be used for the transport of the punched-out board material, and may thereby further simplify the construction of the entire apparatus. As is well known to persons skilled in the art, conveyor or support means for the latter purposes may also be provided in the form of rotating discs, or form of a series of roundsection bars, similar to bars whereon the above-mentioned abutment sheets can be mounted.

The ejector means provided in accordance with the invention may be constructed in form of leaf springs, or in the form of telescoping shells biased to an extended position by a compression spring. In some cases, particularly in cases where apertures are to be punched into multiple ply corrugated board material, the ejectors must resiliently move a considerable distance beyond the cutting edges. In such cases it is preferred to utilize more than two mutually telescoping shells as ejector means, with a suitable compression spring therein. By means of such use of multiple shell ejector means, the end shell can be caused to spring out over a suitably extended distance; yet the ejector in its compressed condition can be contracted so as to let the cutting edge project beyond it, thereby avoiding any need for a particularly increased height of the cutting knife. If has further been found advantageous to mount such ejector shells so that they normally have slight forward inclination relative to their direction of travel with the cylinder whereon they are mounted. This further feature is useful mainly in cases when the corrugated board material tends to bend the ejector shells rearwardly of their said travelling direction.

THe novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
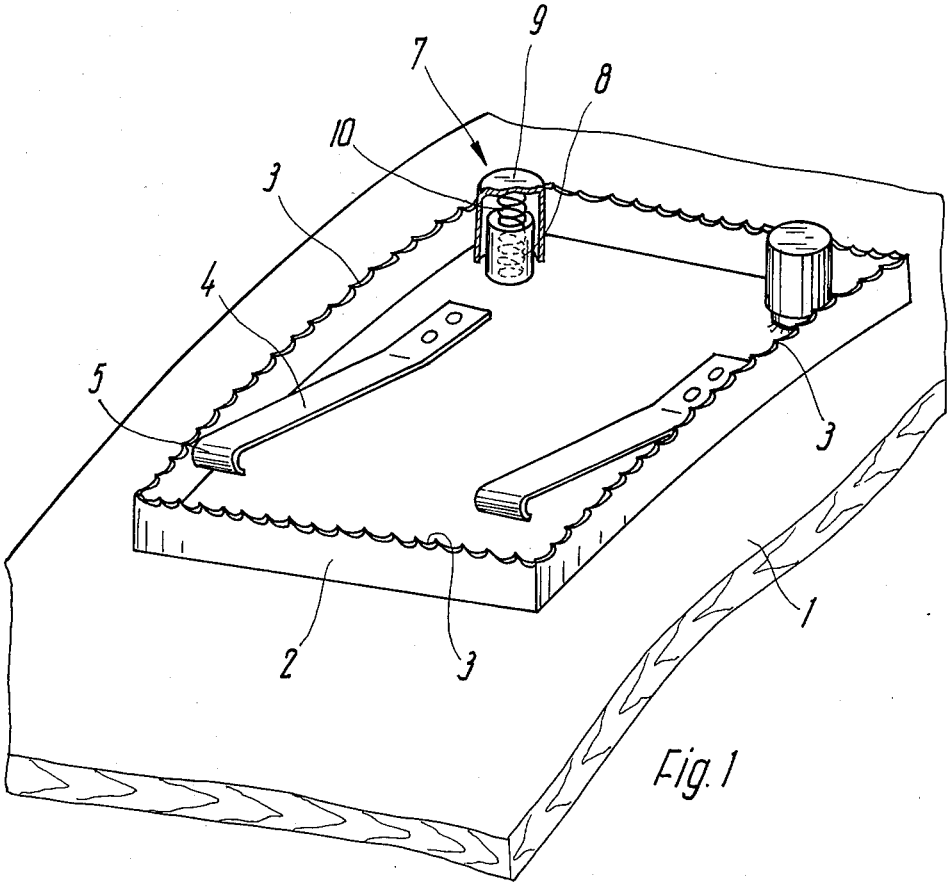
FIG. 1 is a perspective view of a part of the apparatus in accordance with the invention.

As shown in drawing, mounting means 1 (FIG. 1) or 1*a* (FIG. 4) of a punching tool are provided and are attached to rotary cylinder 11 (FIG. 2) by a suitable fastening means, not shown. The mounting means 1 as shown in FIG. 1 carries a punching knife unit for cutting out a rectangular sheet portion as scrap. For this purpose knife tool 2 is arranged in form of a complete and closed rectangle. It will be understood that this tool may be formed of strip steel as has been usual in this art. Lower edge portions of knife or tool 2 are secured in mounting means 1 by any desired contruction, not shown in detail as it is known to persons skilled in the art, and the upper edges of strip 2 are formed as scalloped cutters 3.

In accordance with the invention, FIG. 1 shows ejector means 4, 7 secured to mounting means 1 within the area surrounded by knife tool 2. In a first embodiment of the new apparatus, mounting means 1 has an ejector spring in form of leaf spring 4, one end of which is secured to the mounting means 1; the other and generally free end of ejector leaf spring 4 is bent to rounded shape 5 in order to make sure that the spring can properly enter the punching zone.

Additionally shown in FIG. 1 and additionally usable in conjunction with leaf springs 4 are ejectors 7, each comprising a pair of mutually telescoping shells 8 and 9, the latter being arranged around the former and the former shell 8 being suitably secured to mounting body 1. A helical compression spring 10 is disposed in ejector 7 and extends from the upper end of inner shell 8 to the inside of a closure plate extending across the free end of outer shell 9, the spring reacting between the two shells and resiliently urging outer shell 9 to a position similar to that of rounded end 5 of leaf springs 4.

In further accordance with the invention the ejector means (such as spring 4 or spring apparatus 7) normally projects beyond cutting edge 3 by a distance, measurable radially of the rotary cylinder, which distance is at least equal to the normal thickness of the corrugated board material and is preferably slightly greater than this thickness. This feature is generally indicated in connection with ejector spring apparatus 17 in FIG. 2. The ejector tip of this latter apparatus is in contact with board material portion 13*b*, punching this portion out of the remaining board material 13*a*. Such contact is maintained over a considerable portion of the rotation of the cylinder, and of the ejector on it, and thereby makes the ejection of the punched-out material 13*b* particularly reliable.

Figure 2:
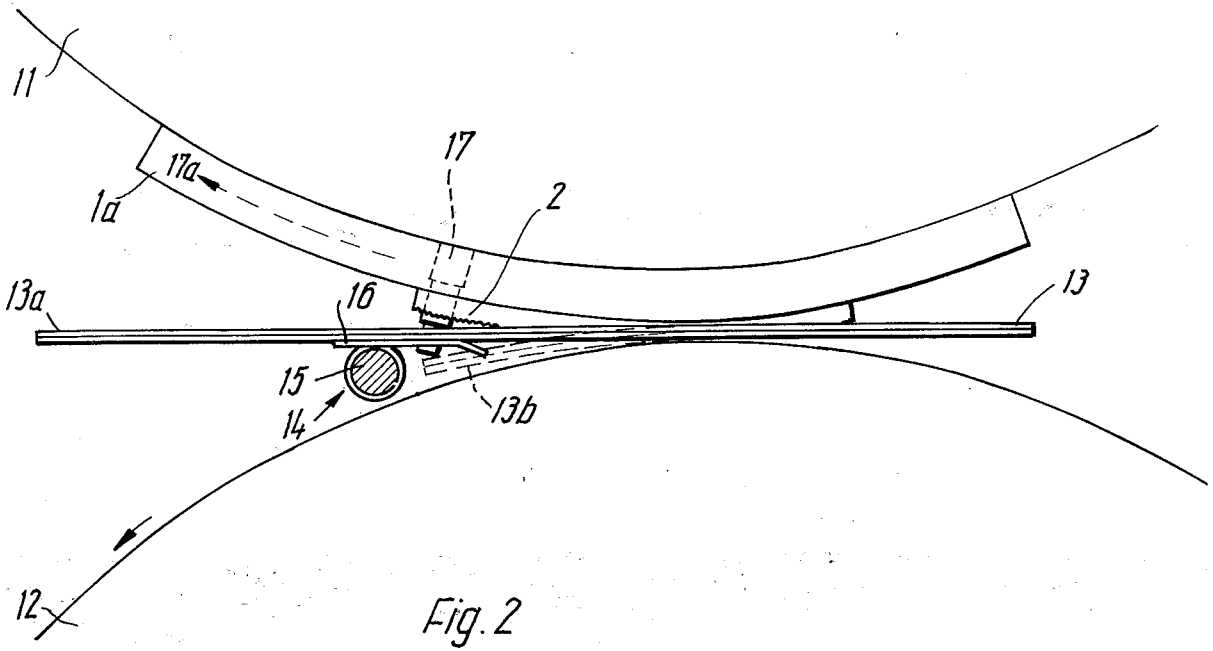
FIG. 2 is a partially sectional side view of the apparatus according to the invention.
Figure 3:
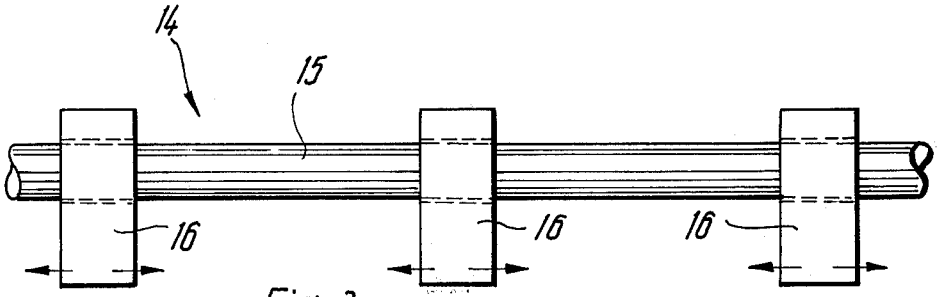
FIG. 3 is a partial plan view of a detail from FIG. 2.

Certain types of corrugated board material 13*a* have a tendency, when leaving the cutting region to yield downwardly, along with the cut-out portions 13*b* of the board material, and thereby to minimize the effect of ejectors 17. In order to prevent such yielding FIG. 2 shows abutment means 14 in form of a cross rod 15, with substantially rigid, horizontal sheets 16 adjustably mounted thereon to receive the remainders 13*a* of the corrugated board material, preferably on both sides of the cut-out portion 13*b* of such material. Such rigid abutment sheets 16 are desirably made of sheet metal. An edge portion thereof, as shown at the right of support rod 14 in FIG. 2, is bent to properly receive corrugated board portions 13*a*. The guide sheet 16 supported by rod 14, prevents the aforesaid downward yielding of said remainder of corrugated board material, and thereby makes sure that for example, a cut-out portion 13*b* produced by a closed cutting tool (FIG. 1) is safely, automatically broken out of the remainder 13*a* of the board material, so that portion 13*b* can be removed in the general direction of the arrow in FIG. 2. Abutment means 14 is also shown in FIG. 3, wherein the lateral adjustment of rigid sheets 16 is indicated by horizontal arrows. By suitable shifting of these guide sheets, abutment apparatus 14 can be brought very close to the working gap of the machine —the area where abutment cylinder 12 is closest to punch cylinder 11—. The abutment thereby contributes to making the machine compact as well as effective.

It will be appreciated that suitable additional abutment for the remainder 13*a* of the punched out corrugated board 13 can also be effected by conveyor belts, known by themselves, which can also be used for removing said remainder 13*a* to the point of use or of further processing. Instead of conveyor belts, round section rods or rotary discs can also be used at this point, as is known to persons skilled in the art of roller conveyors.

Figure 4:
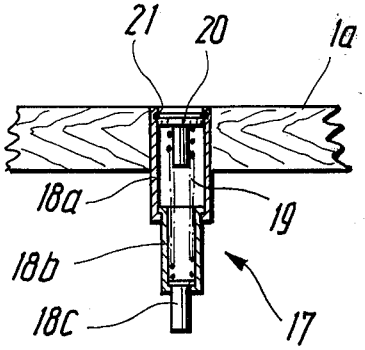
FIG. 4 is a view taken in central vertical section and showing a detail modified from the part shown in FIG. 1.

A third and frequently preferable embodiment of ejector means is shown at 17 in FIGS. 2 and 4. It comprises more than two ejector shells, and is particularly shown in these Figures as having three shells 18*a*, 18*b* and 18*c*, one telescoping with reference to the other. Compression spring 19 is provided within the inner shells 18*a* and 18*b*, with one end of spring 19 bearing against closure 20 of the largest shell 18*a*, while having another end which bears against the smallest shell 18*c*.

The largest shell 18*a* is secured to mounting means 1*a* and is shown as extending through the same to the inner surface thereof, where shell closure 20 can be held in shell 18*a* by a split washer 21 or the like. By virtue of this arrangement it is possible to simply and rapidly interchange compression springs 19 and for example to replace such springs by stronger springs, should this be necessary. By the use of three or more telescoping shells, the shell 18*c* constituting the free end of the ejector can be urged into an extruded position considerably beyond the cutting edge of knife 2; yet it remains possible to compress the entire ejector apparatus 17 so that it finds room within the knife unit 2, FIG. 2, without adding to the height of the steel strips wherefrom this unit is made.

In order to insure reliable ejection of cut-out board material it is suitable to arrange ejectors 4, 7 in the vicinity of the knife strips 2, as is shown in FIG. 1. With particular reference to FIG. 2, it is sometimes advantageous to arrange ejectors 17, of the type having a series of extensible telescoping shells at a slight inclination relative to their travelling direction 17*a*. This arrangement serves to make sure that in spite of the resilient interaction between the corrugated board 13 material and the shells of ejector 17, these shells contact the corrugated board in substantially vertical direction at the point of maximum compression of the ejector spring, thereby minimizing the wear and tear of the ejector apparatus, while making it possible to produce this apparatus from relatively soft and easily machinable materials and thus minimizing the cost of the machine.

The operation of the new machine has been described sufficiently, hereinabove, and will therefore be reviewed only in general outline. Corrugated board material 13, either in form of individual boards or in form of a continuous strip, is suitably fed either manually or automatically, into the working gap between cylinders 11 and 12. As the material passes through this gap, cutting knife apparatus 2 produces the desired knife cuts in the board material. Incident to said cutting, the board material is likely to be compressed to some extent and moreover the knife edges, having passed through the material, are likely to press slightly into the outer contour of abutment cylinder 12, the outer surface portion of this cylinder being formed of suitably compressible material for this purpose. As the corrugated board then leaves the narrowest zone of the working gap, in generally leftward direction, ejector means 17 effects positive displacement of the material portions 13*b* to be punched out, from the remaining portions 13*a* of the corrugated board material, these latter portions being advantageously supported by additional abutment means 14 for this purpose.

When this description and the claims which follow use the expressions "cutting out" and "punching out" or expressions derived therefrom, it will be understood that either complete or partial cutting-out and punching-out is meant. As indicated initially, the cutting knives 2 are not necessarily arranged in form of a closed figure such as the closed rectangle shown in FIG. 1. When the cutting lines are closed, the cut-out and punched-out material may frequently be designated as "scrap", but when for example one of the sides of a rectangular aperture remains open, the "cut-out" and "punched-out" material 13*b* remains part of the final corrugated board product 13*a* and constitutes for example a tab attached thereto.

While the invention has been illustrated and described as embodied in a rotary apparatus for punching apertures into corrugated board material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features which, from the standpoint of prior art, fairly constitute essential characteristics of the generic or specific aspects of this invention and, therefore, such adaptations should and are intended to be comprehended within the meaning and range of equivalence of the following claims.

I claim:

1. Rotary apparatus for punching apertures into corrugated board material, comprising rotatable cylinder means having a peripheral surface; board abutment means opposite and spaced from said peripheral surface; knife means on said cylinder means, said knife means having a cutting edge for cutting out a portion of board material fed between said peripheral surface and said abutment means during rotation of said cylinder means; spring-loaded ejector means for displacing the cut-out portion of the board material relative to the remainder thereof during further rotation of said cylinder means, said ejector means including telescopingly-arranged shells and a spring disposed within said shells; and mounting means for removably mounting said knife means and said ejector means on said rotatable cylinder means.

2. Apparatus as defined in claim 1, wherein said knife means comprises a strip of steel, and means for mounting said strip substantially radially projecting from said cylinder means.

3. Apparatus as defined in claim 1, wherein said abutment means comprises another cylinder, rotatably mounted to define with said one cylinder means a gap for passage of the corrugated board material through said gap incident to said cutting.

4. Apparatus as defined in claim 3, wherein said other cylinder has surface structure slightly compressible incident to said cutting.

5. Apparatus as defined in claim 1, and including additional abutment means comprising substantially rigid sheet means mounted opposite said cylinder means, for abutting said remainder of board material while the cut out portion is displaced relative to said remainder.

6. Apparatus as defined in claim 1, wherein said ejector means includes a leaf spring having one end secured to said rotatable cylinder means.

7. Apparatus as defined in claim 6, wherein the leaf spring has a free end in rounded form, to facilitate passage into the working area of the machine.

8. Apparatus as defined in claim 1, wherein the ejector means comprises a plurality of ejectors, all disposed adjacent said knife means.

9. Apparatus as defined in claim 1, wherein said shells are mounted in positions slightly inclined to their direction of travel with said rotatable cylinder means.

10. Rotary apparatus for punching apertures into corrugated board material, comprising rotatable cylinder means having a peripheral surface; board abutment means opposite and spaced from said peripheral surface; knife means on said cylinder means, said knife means having a cutting edge defining an outline for cutting out a portion of board material fed between said peripheral surface and said abutment means during rotation of said cylinder means; and a plurality of springloaded ejector means spaced from one another and mounted on said cylinder means within said outline and operative to displace the cut-out portion of the board material relative to the remainder thereof during further rotation of said cylinder means, said ejector means normally projecting beyond said cutting edge by a distance radially of said cylinder means, at least equal to the normal thickness of the corrugated board material.

11. Apparatus as defined in claim 10, wherein said ejector means normally projects beyond said cutting edge by a distance slightly greater than said normal thickness.

12. A rotary apparatus for punching apertures into corrugated board material, comprising rotatable cylinder means having a peripheral surface; board abutment means opposite and spaced from said peripheral surface; knife means on said cylinder means, said knife means having a cutting edge defining an outline for cutting out a portion of board material fed between said peripheral surface and said abutment means during rotation of said cylinder means; and a plurality of spring-loaded ejector means spaced from one another and mounted on said cylinder means within said outline and operative to displace the cut-put portion of the board material relative to the remainder thereof during further rotation of said cylinder means, said ejector means having a first shell having one end secured to said rotatable cylinder means, a second shell concentric with said first shell, and a compression spring disposed within said shells to bias said second shell in an outward direction relative to said cylinder means.

13. Apparatus as defined in claim 12 including mounting means for removably mounting said knife means and ejector means on said rotatable cylinder means.

14. Apparatus as defined defined in claim 13, wherein said ejector means includes mutually telescoping shells, one of said shells being secured to said mounting means and extending through the same; and a closure of the said last-mentioned shell providing an abutment for said spring and removably arranged at the inner end of said one shell.

15. Apparatus as defined in claim 12, including additional shell means telescopingly arranged with respect to the aforementioned shells.

16. Rotary apparatus for punching apertures into corrugated board material, comprising rotatable cylinder means having a peripheral surface; board abutment means opposite and spaced from said peripheral surface; knife means on said cylinder means, said knife means having a cutting edge for cutting out a portion of board material fed between said peripheral surface and said abutment means during rotation of said cylinder means; resilient ejector means mounted on said cylinder means to displace the cut-out portion of the board material relative to the remainder thereof during further rotation of said cylinder; additional abutment means having substantially rigid sheet means including a series of metal sheets, said additional abutment means mounted opposite said cylinder means for abutting said remainder of board material while the cut-out portion is displaced relative to said remainder; a support rod mounted adjacent said cylinder means and extending substantially parallel to the axis of said cylinder means; and means for adjustably mounting said metal sheets on said support rod.

17. Rotary apparatus for punching apertures into corrugated board material, comprising rotatable cylinder means having a peripheral surface; board abutment means opposite and spaced from said peripheral surface; knife means on said cylinder means, said knife means having a cutting edge for cutting out a portion of board material fed between said peripheral surface and said abutment means during rotation of said cylinder means; and resilient ejector means mounted on said cylinder means to displace the cut-out portion of the board material relative to the remainder thereof during further rotation of said cylinder, said ejector means having a first shell including one end secured to said cylinder means, a second shell concentric with said first shell, said shells being mounted in positions slightly inclined to their direction of travel with said cylinder means, and a compression spring disposed within said shells to bias said second shell in an outward direction relative to said cylinder means.

* * * * *